US006889845B2

(12) United States Patent
Ermekova et al.

(10) Patent No.: US 6,889,845 B2
(45) Date of Patent: May 10, 2005

(54) JIGGING MACHINE

(75) Inventors: Gulnar Ermekova, Karaganda (KZ); Burkit Mainin, mikroraion Kungei, 574, 470074 Karaganda (KZ); Zhanat Mainina, Karaganda (KZ); Zhibek Mainina, Karaganda (KZ)

(73) Assignee: Burkit Mainin, Karaganda (KZ)

( * ) Notice: Subject to any disclaimer, the term of this patent is extended or adjusted under 35 U.S.C. 154(b) by 118 days.

(21) Appl. No.: 10/348,667

(22) Filed: Jan. 21, 2003

(65) Prior Publication Data

US 2004/0149631 A1 Aug. 5, 2004

Related U.S. Application Data

(63) Continuation of application No. PCT/KZ00/00004, filed on Jul. 27, 2000.

(51) Int. Cl.[7] ..... B03B 5/24; B07B 1/42

(52) U.S. Cl. ..... 209/365.1; 209/380; 209/487; 209/504; 209/508

(58) Field of Search ..... 209/13, 269, 309, 209/325, 326, 327, 331, 332, 364, 365.1, 365.2, 373, 379, 380, 425, 427, 448, 449, 486, 487, 504, 508

(56) References Cited

U.S. PATENT DOCUMENTS

| | | | | | |
|---|---|---|---|---|---|
| 236,730 | A | * | 1/1881 | Stephens | 209/475 |
| 276,534 | A | * | 4/1883 | Hershey et al. | 209/479 |
| 307,573 | A | * | 11/1884 | Nevins | 209/427 |
| 506,751 | A | * | 10/1893 | Wall | 209/427 |
| 4,056,464 | A | * | 11/1977 | Cross | 209/425 |
| 4,070,275 | A | * | 1/1978 | Stoev et al. | 209/44 |
| 4,319,990 | A | * | 3/1982 | Muller | 209/240 |
| 6,234,319 | B1 | * | 5/2001 | Wang | 209/479 |
| 2004/0112801 | A1 | * | 6/2004 | Ermekova et al. | 209/405 |

FOREIGN PATENT DOCUMENTS

| | | | | |
|---|---|---|---|---|
| DE | 3308810 A1 | | 9/1984 | |
| DE | 3611234 C1 | * | 10/1987 | B07B/1/46 |
| JP | 04180873 A | * | 6/1992 | B07B/1/55 |
| RU | 2047377 C1 | | 11/1995 | |
| SU | 1247109 A1 | | 7/1986 | |
| SU | 1659101 A1 | | 6/1991 | |
| WO | WO 2062480 A2 | * | 8/2002 | |
| WO | WO 2081091 A1 | * | 10/2002 | B03B/5/12 |

* cited by examiner

*Primary Examiner*—Donald P. Walsh
*Assistant Examiner*—Joseph Rodriguez
(74) *Attorney, Agent, or Firm*—Fraser Martin Buchanan Miller LLC

(57) ABSTRACT

A jigger for the processing of minerals such as coal, consisting of two traveling troughs, the upper trough being equipped with a sieve and closed from below by a continuous flexible membrane, the lower trough interrelating with the diaphragm of the upper trough, acting as a piston and giving water vertical pulsation. The troughs are linked to each other via double-arm levers, hinged in the supports. The double-arm levers together with the troughs form a system of hinged parallelograms, providing uniform distribution of pulsations along the whole capacity of the upper trough that produces conditions for the intensification of the jigging process. Besides this intensification, decreasing of energy-consumption and simplicity of design having been achieved. A laboratory sample was made and its testing showed good technological results and confirmed the reliability of a unit simple in manufacturing, operating and maintenance.

5 Claims, 1 Drawing Sheet

JIGGING MACHINE

CROSS-REFERENCE TO RELATED APPLICATION

Figure 1:
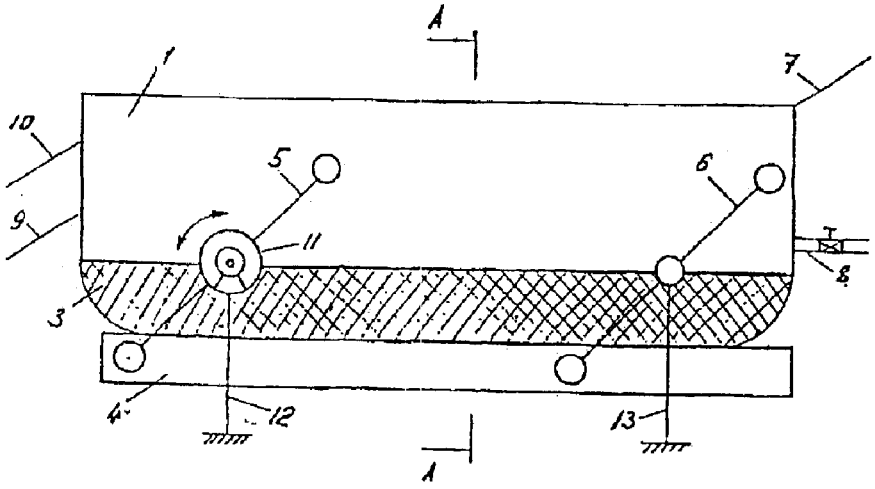

This application is a continuation of PCT/KZ00/00004 filed Jul. 27, 2000 claiming priority of Kazakhstan Patent Application No. 2000/0825.1 filled Jul. 24, 2000.

The invention under discussion is in the field of dressing mineral deposits by the method of hydraulic jigging in the jigging plants and may be used in ore and coal mining as well in some other industries.

THE PREVIOUS HISTORY OF TECHNIQUE LEVEL

There are jigging plants with traveling sieve, for example, (Directory on ore dressing. Fundamental processes. Moscow "Bowels Publishers. 1983. P. 53–54) the sieve is being given bow-shaped movement with horizontal replacement to the side of loading mineral while the sieve moving downwards and then forward on going upwards. As the result of it the positive effect of simultaneous uprising of all bed and moving of all mineral processed along the sieve is being achieved, the movement control being fulfilled by the replacement of plates with cranks on the movable boards.

The disadvantage of the plant is insufficient loosening of minerals bed in the loading part of the sieve and intermixing of separated fractions as well. Thus, the efficiency of mineral processed is low. Because of this and some other reasons such type of a jigger with traveling sieve didn't find wide application.

As a prototype for our invention was used a jigger "The WEMCO REMER JIG (Samylinma, Zolatco AA, Pochinok VV. Jigging/Moscow Bowels Publishers. 1976 p. 202). The device has an upper untravelling trough with sieve and lower travelling one; they are connected by rubber diaphragm along perimeter. The lower sieve is being given vertical reciprocating movement by means of special doubled eccentric mechanism. As a result, vertical pulsation of under—sieve water has been achieved that is very important for jigging process.

The disadvantage of the prototype are the complexity of the design due to the eccentric unit, high inertiability of the lower part of the plant and as the result of it high energy-consumption because of the fact that each stage of jigging reguires uprising of the lower trough with the whole quantity of water; low efficiency of jigging process as there is no accurate simultaneous uprising of the whole bed that is characteristic to the jiggers with untravelling trough.

THE ESSENCE OF THE INVENTION

The technical purpose of the invention is designing a jigger simple in construction but with intensive and low energy-consuming jigging process.

We offer a jigger with two traveling troughs hinged by double-arm levers, the upper having a sieve inside with continuous flexible membrane in the lower part, interacting with the lower trough. The double-arm levers are hinged with supports. Reciprocating movement of troughs is being provided by setting driving gear in the centre of rotation axel of double-arm levers, for example, centre weir rotating hydro engine. As a result, reciprocating movement of troughs is being given both vertically-for jigging process and horizontally—for transporting mineral processed to the place of unloading out of the jigger.

In the case the design is simplified because the lower trough performs the function of a piston producing pulsation of the under-sieve water vertically. The double-arm levers together with the troughs form a system of hinged parallelogram, that provides uniform pulsation of the under-sieve water along the whole capacity of the upper trough and produces conditions for intensification of jigging process.

Synchronically with the lower trough's traveling downwards there is a replacement of the upper trough with sieve upwards, that provides simultaneous uprising of the whole bed. It is very important for the efficiency of jigging process and the usage of jiggers with traveling trough proved it/Bent P.O. Technology of gravitational processing. Translation from English/Moscow, Bowels Publishers, 1990 p 219–220.

While the upper trough with the sieve travels downwards the lower one synchronically travels upwards and acting upon membrane produces vertical pulsation of the under-sieve water, that is also very important for jigging process.

In one unit two advantages of jiggers with traveling and untravelling sieve have been realized because of intensification of the jigging process. High efficiency of the forced efforts-namely, driving gear's effort—is being achieved; consequently energy-consumption of the jigging process is less and due to matching masses of upper and lower troughs, water quantity in the upper trough and mass of mineral processed it's possible to get a system wholly balanced cinematically.

SHORT DESCRIPTION OF DRAWINGS

Figure 2:
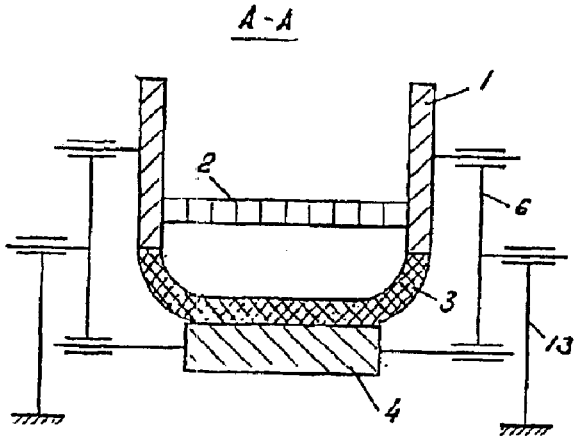
Figure 3:
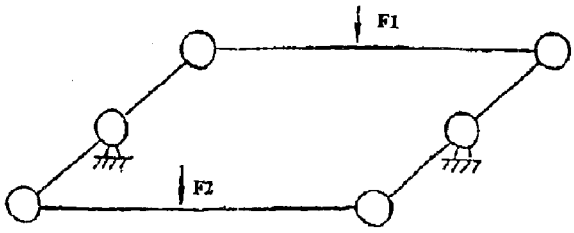

FIG. 1—the scheme of jigger, side-view,

FIG. 2 cross-cut AA on FIG. 1;

FIG. 3—cinematic scheme of jigger /F1=F2—the condition for the balance of the system, where F1 and F2—efforts, produced by masses of the upper trough with sieve, lower trough, mineral processed and water 1/.

VARIANTS OF REALIZATION OF THE INVENTION

The jigger under discussion has upper trough 1 with untravelling sieve 2 that is closed from below by flexible membrane 3; lower trough-piston 4, interrelating with the flexible membrane and hinged with upper trough 1 and double-arm levers 5 and 6 with the help for example, antifriction bearing; double-arm levers are at the front and end parts of troughs 1 and 2. On the back butt-end of upper trough 1 there is a loading unit 7, water via flexible hoses 8 is being forced under sieve 2, unloading of processed products being performed through unloading units 9 and 10, that are located on the front butt-end of trough 1. Troughs are being activated by driving gear 11. Double-arm levers 5 and 6 are hinged with supports 12 and 13.

The jigger operates in the following way; mineral to be processed is being given to upper trough 1 out of loading unit 7. Driving gear 11 forces troughs 1 and 4 move reciprocatingly. Synchronically with traveling lower trough 4 downwards upper trough 1 with sieve 2 travels upwards that results in uprising of the whole bed. On traveling upper trough 1 with sieve 2 downwards lower one 4 synchronically travels upwards and acting upon flexible membrane 3 produces vertical pulsation of the under-sieve water. The products of processing are being delivered out through unloading units 9 and 10. Loss of water while unloading is being compensated by permanent provision of water through hose 8.

INDUSTRIAL IMPLEMENTATION

The multi-functionality of the invention is additional technical advantage, the possibility of using it as a transport vehicle, moreover transporting is being performed along the inclined upwards; then taking away the flexible membrane and installing the sieve with appropriate size of holes it is possible to use if for classifying mineral according to coarseness.

Cinematic scheme of the device permits to increase the unitary capacity of jigger by means of simple increasing linear measurements both in width and length without making the plant's construction complex. Using revolving hydroengine as a driving gear gives the possibility to regulate efficiently two most important parameters of the jigging process-amplitude and frequency of pulsation without the jigger's stop.

A laboratory sample of the jigger was made and its testing showed positive technological results in jigging and also confirmed the reliability of the device, simplicity of design, manufacturing and maintenance. At present the work is in the progress to manufacture a device for trial industrial usage.

Thus, constructive differences of the jigger offered permit to solve technological task; intensification of jigging process without losing quality, decreasing of energy consumption, simplifying the jigger's construction and certainly these differences are of great importance. As we think, the present differences give up-to-date technological level to the device. And its industrial usage is beyond any hesitation.

What is claimed is:

1. Jigger comprising:

a movable upper trough having a sieve inside, a movable lower trough, a driving gear, and devices for loading minerals, for water delivery and for unloading processed products, characterized in that the upper trough is equipped with an underlying continuous flexible membrane interacting with the lower trough, and in that the upper and lower troughs are hinged by double-arm levers, the latter being in turn hinged on supports, wherein the upper trough, the lower trough, and the double-arm levers in combination form a system of hinged parallelograms, said driving gear capable of pivotally actuating the double-arm levers relative to the supports to move each one of the upper and lower troughs in a reciprocating motion by which the upper and lower troughs are moved relative to one another.

2. A jigger, comprising:

an upper trough having a sieve therein, closed from below by a continuous flexible membrane, and defining two sides, said upper trough destined to contain water and minerals to be processed;

a lower trough defining two sides;

a number of double-arm levers each defining first and second ends, each lever hinged at its said first end to a corresponding side of said upper trough, and each lever hinged at its said second end to a corresponding side of said lower trough;

at least two supports, each support pivotally carrying a corresponding one of said double-arm levers;

a driving gear, for pivotally actuating each said double-arm lever with relation to said supports; and devices for loading minerals, for water delivery and for unloading processed products, wherein said upper trough, said lower trough, and said double-arm levers form in combination a system of hinged parallelograms for swingingly displacing each one of said upper and lower troughs in a reciprocating fashion, and to move said upper and lower troughs relative to one another.

3. The jigger according to claim 2, wherein said driving gear can actuate said upper trough and said lower trough both vertically and horizontally, and wherein said lower trough, when in motion, can act upon said flexible membrane for producing a vertical pulsation on the water contained in said upper trough, and wherein the horizontal movement of said upper trough allows for the minerals contained in said upper trough to be transported towards said devices for unloading processed products.

4. A jigger, comprising:

an upper trough having a sieve therein, closed from below by a continuous flexible membrane, said upper trough destined to contain water and minerals to be processed;

a lower trough;

a number of levers pivotally carrying said upper trough;

a number of supports, each pivotally carrying a corresponding said lever;

a driving gear, for pivotally actuating each said lever with relation to said supports; and devices for loading minerals, for water delivery and for unloading processed products, wherein said driving gear can be actuated to pivot said levers with relation to said supports in order to swingingly move said upper trough in a reciprocating fashion, to displace said upper trough vertically relative to said lower trough to allow the latter to act upon said flexible membrane for producing a vertical pulsation on the water contained in said upper trough, and to displace said upper trough horizontally for allowing the minerals contained in said upper trough to be transported towards said devices for unloading processed products.

5. The jigger according to claim 4, wherein said levers are double-arm levers, also pivotally carrying said lower trough spaced from said upper trough, said driving gear being capable of actuating said double-arm levers to move said upper and lower troughs relative to each other and in a reciprocating fashion.

* * * * *